US006257553B1

(12) United States Patent
Khachatoorian

(10) Patent No.: US 6,257,553 B1
(45) **Date of Patent: *Jul. 10, 2001**

(54) UTILITY BAR

(75) Inventor: Zareh Khachatoorian, Northridge, CA (US)

(73) Assignee: Olympia Group, Inc., City of Industry, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/406,055

(22) Filed: Sep. 27, 1999

(51) Int. Cl.[7] ..... B66F 15/00
(52) U.S. Cl. ..... 254/25; 254/21
(58) Field of Search ..... 254/25, 21, 30, 254/27, 19, 18, 23

(56) References Cited

U.S. PATENT DOCUMENTS 3,134,574 * 5/1964 Reuterfors ..... 254/25
4,844,416 * 7/1989 Hand ..... 254/25
5,577,711 * 11/1996 Shrine ..... 254/25
5,695,712 * 12/1997 Hreha ..... 254/25
5,957,429 * 9/1999 Khachatoorian ..... 254/25

* cited by examiner

*Primary Examiner*—Joseph J. Hail, III
*Assistant Examiner*—Lee Wilson
(74) *Attorney, Agent, or Firm*—Lackenbach Siegel Marzullo Aronson & Greenspan, P.C.

(57) ABSTRACT

An improved utility bar includes an elongate shank which has a longitudinal axis, a prying hook at one end and a prying chisel at the other end. The prying hook has a tapered portion extending along a direction generally an angle α with the longitudinal axis and a generally U-shaped portion integrally formed with the shank and the tapered portion. The tapered and U-shaped portions together form a prying footprint surface facing a direction away from the shank. The angle α is selected to be greater than 90° and preferably selected within the range of 93°–110°. The prying footprint has a minimum transverse dimension which is substantially greater than the minimum cross sectional dimension of the shank.

19 Claims, 3 Drawing Sheets

UTILITY BAR

BACKGROUND OF THE INVENTION

1. Field of the Invention

This invention generally relates to hand tools and, more specifically, to an improved utility bar for moving or prying objects.

2. Description of the Prior Art.

Numerous utility bars or prying tools have been known, these exhibiting different configurations and sizes. All of the bars in this category operate on the principle of the simple first class lever. A first class lever is a lever wherein the load to be overcome is at or near one end of a rod or bar, and the effort or force is applied at or near the other end of the rod or bar, and the fulcrum, or pivot, is somewhere along the rod or bar inbetween the applied force and load. Thus, the user seeks to obtain a mechanical advantage by placing one end of the bar adjacent to the surface to be moved, and providing a pivot point about which a longer moment arm is provided so that substantial forces can be provided to the surface and/or the object to be pried open or moved. For example, one utility bar is a ripping bar in the form of a straight elongate bar having a generally hexagonal cross section and provided with a wedge or tapered end that can be forced between two adjacent surfaces. However, because such a ripping bar is a straight bar, it has limitations in the applications for which it can be used. For example, it is not convenient to use it when a heavy object has a surface in contact with a floor or has a surface which is in contact with a wall. Because the tapered or beveled edge must be inserted while the bar is substantially parallel to the floor or wall, respectively, it may be difficult in some instances for the bar to be held by the user since that portion of the bar which is held by the user's hand may be too close to or may abut an adjacent surface. A wrecking bar similarly has an elongate member of hex cross section provided with a tapered or beveled chisel tip, which may be somewhat offset from the longitudinal axis of the bar at one end. The other end of the bar is similarly provided with a tapered or beveled edge which is, however, bent between 90° and 180° so as to form a neck portion with the second beveled or tapered tip being directed in a direction substantially the same as the first tip. While this tool may be useful in applying prying forces to relatively small areas, such as automobile wrecks, it suffers the same aforementioned disadvantages of the ripping bar insofar as moving objects close to a floor or wall surface since such surfaces become obstacles to the convenient insertion of the tapered or beveled edges between the surfaces to be pried.

A utility bar is also known generally formed of flat steel material which has a tapered or beveled tip at one end and a neck portion which directs the beveled or tapered tip at the other end in a direction substantially normal to the longitudinaldirection of the bar extending between the tips. Aside from lacking the structural strength or integrity of the ripping and wrecking bars, which have a more substantial hexagonal cross section, directing the second beveled or tapered tip in a direction substantially normal to the longitudinal direction of the bar also makes it very difficult or inconvenient to place the second tip between surfaces that are close to a floor or to a wall since, again, the hand of a user typically abuts against the floor or the wall when the bar is held by the user during insertion of the tip between the surfaces. A nail puller is also known which has a substantially similar tip at the end of a bar with a hex cross section, in which the tip provided with the nail pulling slot is directed substantially normally to the longitudinal direction of the bar to which the user's hand applies a force.

There is also known a T-type wrecking bar which typically also has a hex cross section elongate bar provided with a tapered or beveled edge at one end, as with the wrecking bar. At the other end, however, there is provided a cross bar which is integrally formed at the end of the elongate bar to simulate a T-shape. Each end of the cross bar is itself tapered or beveled. In order to render this bar more useful, the end of the elongate bar which supports the cross bar is frequently bent somewhat between 5° and 30° so that one of the tapered or beveled edges on the cross bar forms a smaller angle with the elongate bar than does the other beveled or tapered edge of the cross bar. However, although one of the tips on the cross bar may be more convenient to insert between two surfaces than the other tip, this type of wrecking bar does not include a rounded neck portion about which pivoting action can take place. Instead, the pivoting action for each of the tips at the end of the cross bar is about the other tip of the same cross bar. Such arrangement is not always easy to use and becomes impractical in many applications.

Furthermore, because of the inherent limitations in the prior art bars, it was frequently necessary for a user to purchase and use more than one of the bar designs to accommodate different or specific applications.

Another disadvantage of some of the known utility bars, particularly the wrecking bar, is that the fulcrum for the pivoting action, between the prying arm and the moment arm, is the bent hex rod itself This results in a relatively small footprint area which creates extremely high concentrated stresses on the surface on which the pivoting action takes place. This frequently results in the "sinking" of the fulcrum into the surface and deformation and damage thereto.

SUMMARY OF THE INVENTION

Accordingly, it is an object of the present invention to provide a utility bar that does not have the disadvantages inherent in prior such bars.

It is another object of the present invention to provide a utility bar that is simple in construction and economical to manufacture.

It is still another object of the present invention to provide a utility bar of the type under discussion which can replace two or more of the prior bars and, therefore, obviate the need to have multiple bars to do a number of different applications.

It is yet another object of the present invention to provide a utility bar to provide a utility bar as in the previous objects which is usable with both small and large objects.

It is a further object of the present invention to provide a utility bar as suggested above which can be used to move a surface very close, adjacent or abutting a floor or wall surface.

It is still a further object of the present invention to provide a utility bar as in the previous objects which provides good mechanical advantage under a variety of conditions of use.

It is yet a further object of the present invention to provide a utility bar as mentioned above which permits the user to apply substantial prying forces to the bar while minimizing pain or discomfort to the user's hand.

It is an additional object of the present invention to provide a utility bar which provides significant prying forces while maintaining a sufficiently large footprint to minimize the sinking of the bar and deformation of the surface upon which pivoting takes place.

In order to achieve the above objects, as well as others which will become evident hereafter, a utility bar in accordance with the present invention is provided with an elongate shank defining a longitudinal axis and having a prying hook at one end and a prying chisel at the other end. Said prying hook has a tapered portion extending along a direction generally defining an angle $\alpha$ with said longitudinal axis and a generally U-shaped portion integrally formed with said shank and said tapered portion, said tapered and U-shaped portions forming a prying footprint surface facing a direction away from said shank, said angle a being selected to be greater than 90°. Said prying footprint is provided with a minimum transverse dimension which is substantially greater than the minimum cross sectional dimension of said shank.

In accordance with the invention, said angle $\alpha$ is preferably selected from the range of 90°–110°.

BRIEF DESCRIPTION OF THE DRAWINGS

These and other objects, features and characteristics of the present invention will be more fully apparent, understood and appreciated from the ensuing detailed description, when read with reference to the various figures of the accompanying drawings, wherein.

DESCRIPTION OF THE PREFERRED EMBODIMENT

Figure 1:
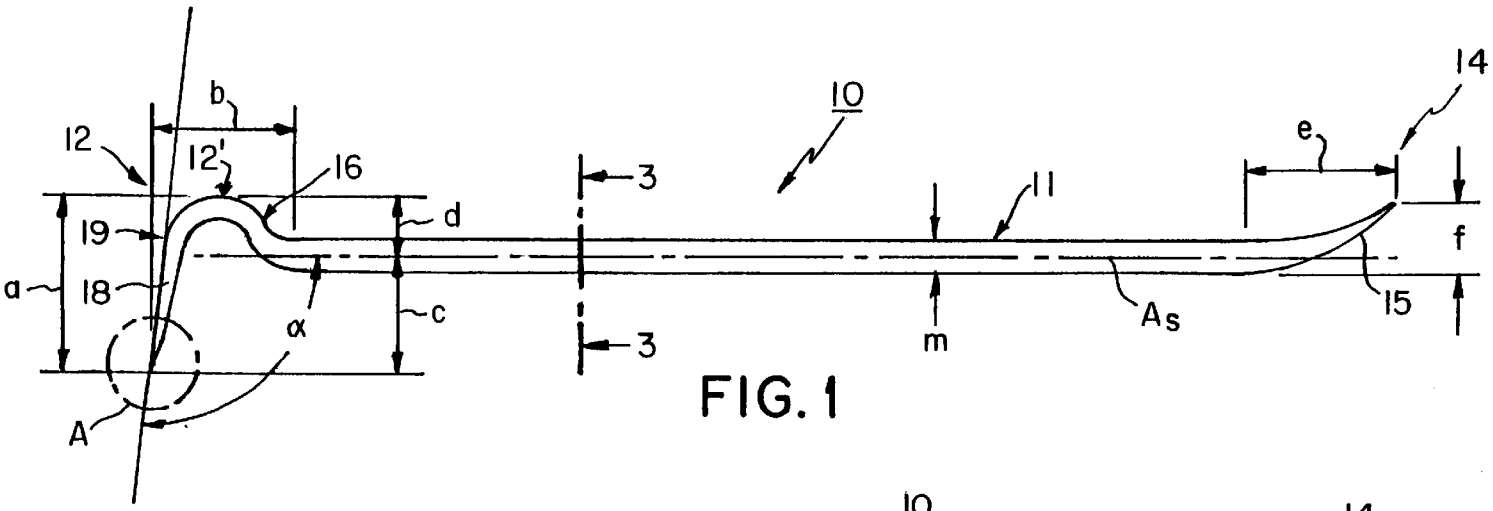
FIG. 1 is a side elevational view of the improved utility bar in accordance with the present invention.
Figure 2:
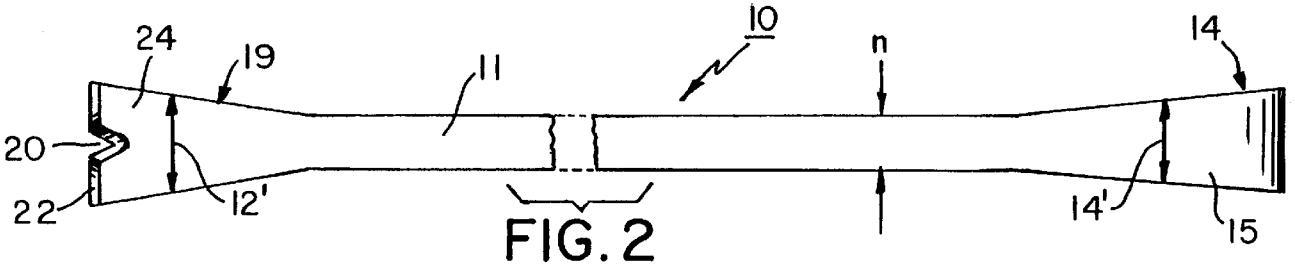
FIG. 2 is a top elevational view of the utility bar shown in FIG. 1.
Figure 4:
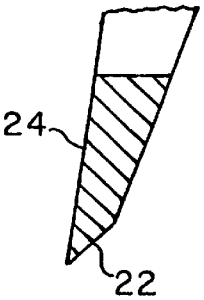
FIG. 4 is an enlarged fragmented view of the detail A shown in FIG. 1.

Referring now specifically to the Figures, in which identical or similar parts are designated by the same reference numerals throughout, and first referring to FIGS. 1 and 2, an improved utility bar in accordance with the present invention is generally designated by the reference numeral 10.

The utility bar 10 includes a generally elongate bar defining a longitudinal shank 11 defining an axis $A_s$ and having a prying hook 12 at one end axial end and a prying chisel 14 at the other axial end. The prying hook 12 has a generally U-shaped portion 16 integrally formed with the elongate shank 11 and with a tapered portion 18 which forms an angle $\alpha$ with the longitudinal axis $A_s$. The U-shaped portion 16 and the tapered portion 18 together form a prying footprint surface 19 which faces a direction away from the shank 11.

In accordance with one aspect of the invention, the angle $\alpha$ is selected to be greater than 90°. While this angle is shown in the illustrated embodiment to be approximately equal to 96°, the angle is preferably selected from the range 93°–110°. It has been also found that an angle of $\alpha$=105° provides many of the advantages of the present invention.

Another aspect of the present invention is that the prying footprint 19, which forms a part of the fulcrum point about which prying takes place with the prying hook 12, has a minimum transverse dimension which is substantially greater than the minimum cross sectional dimension of the shank.

The tapered portion 18 may be provided with a V-shaped nail-pulling notch indicated by the reference numeral 20 in FIG. 2.

Figure 3:
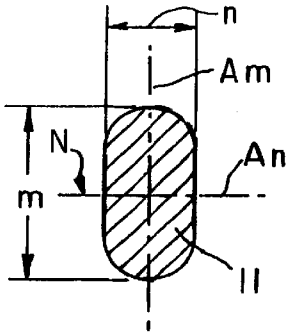
FIG. 3 is a cross sectional view of the bar shown in FIG. 1, taken along line 3—3.

As indicated, many of the utility bar tools that have been used either have a hexagonal cross section at the shank or a generally flat configuration. The flat configuration not only provides sharp edges but is also susceptible to deformation and breakage if sufficiently high forces are applied by the user. Breakage of a utility bar during use can cause substantial injury to the user as well as damage to the work. Referring to FIG. 3, a cross section is shown of the shank 11. In accordance with one presently preferred configuration, the shank 11 does not exhibit any sharp edges. Such a shank may, for example, be generally oval in cross section. However, even a rectangular shape with rounded edges as shown may be used. When an oval configuration is used, the cross section preferably defines a major and minor axes $A_m$, $A_n$ having relative dimensions approximately in the ratio of 2:1. It should be clear, however, that this ratio used is not critical, and different ratios may be used, with different degrees of advantage. However, because of the significant forces that may be applied to the shank, it is preferred that the neutral plane N substantially coincide with the minor axis $A_n$ or the smaller of the dimensional cross sections. In this way, the shank 11 is substantially rigid while maintaining a smaller cross sectional area for a given strength. This allows the shank to be more comfortably, easily and fully gripped by the hand of the user. As also illustrated in FIGS. 1 and 2, the working lengths of the prying hook 12 and the prying chisel 14 have approximately the same lengths along the direction of the shank axis $A_s$.

As indicated, the prying hook consists of a substantially U-shaped portion 16 and a substantially straight tapered portion 18. The outer leg of the U-shaped neck 16 and the tapered portion 18 together define a footprint which serves as a fulcrum point about which the tool is pivoted. The prying footprint is preferably selected so that it has, during use, a minimum transverse dimension which is greater than the minimum cross sectional dimension of the shank 11. Also, the tapered portion 18 is provided with a beveled edge 22 to facilitate insertion against a surface to be moved.

The entire utility bar is preferably made of forged steel which is heat treated to render it more rigid.

In FIGS. 1 and 3 it will be clear that when the shank has a substantially oval cross section the major axis is generally parallel to the tapered portion 18, although variations from such parallel relationship can be acceptable, as shown in FIG. 1, in order to facilitate the insertion or penetration of the beveled edge between two abutting surfaces. Also, the dimension of the prying hook 12 is less than the dimension of the prying chisel 14 along the direction of the longitudinal axis $A_s$, since the tapered portion of the prying chisel is inserted between two surfaces along a direction generally parallel to the axis $A_s$, while the portion of the prying hook which is inserted between two abutting surfaces is moved along a direction which is substantially normal or perpendicular to the axis $A_s$. Depending on the amount of penetration that needs to be attained prior to actual prying, substantially equal lengths of tapered edges, at both ends or tips, are directed or oriented in perpendicular directions.

In the specific embodiment illustrated, the cross sectional dimensions of the shank 11 are such that the major axis "m" is 30 mm and the minor axis "n" is 16 mm. Such enhanced amount of material to both sides of the neutral plane N renders the bar rigid notwithstanding its overall length dimension of, for example, 600 mm for a smaller size utility bar or 900 mm for a larger utility bar. In both instances, the utility bar remains substantially straight and deflection is minimal within anticipated prying forces. The transverse dimension "a" of the prying hook 12 is approximately 115 mm, while the dimension "b" of the hook along the longitudinal axis is approximately 125 mm. The longitudinal dimension of the prying chisel along the axis $A_s$ is 155 mm ("e"), while the transverse dimension over that length ("f") is 52 mm. Referring to FIG. 1, the dimension "c" of the straight tapered portion 18 is approximately 76 mm, while the transverse dimension "d" of the U-shaped portion 16 is approximately 38 mm, so that the neutral plane N or the axis $A_s$ generally intersects the prying hook at a point approximately where said tapered portion 18 is arranged on one side and the generally curved U-shaped portion is arranged on the other side of the longitudinal axis. The relative dimensions "a", "b" and "c" are not, per se, critical, as long as the length of the tapered portion 18 is sufficiently long to project beyond the axis $A_s$.

The specific dimensions are merely illustrative of the shape and relative dimensions. Clearly, the utility bar can be made in different sizes in which cases the absolute dimensions will change, although the relative dimensions should generally be maintained to retain the advantages of the present invention.

Figure 5:
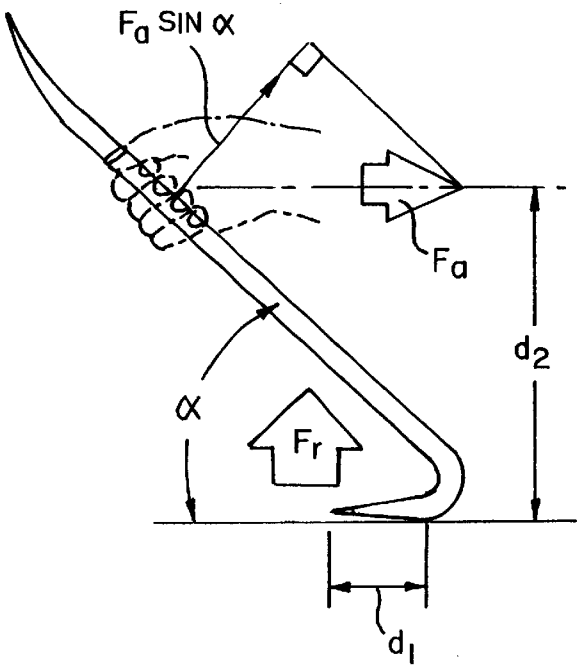
FIG. 5 PRIOR ART
FIG. 5 illustrates a typical or conventional wrecking bar, showing the directions of the prying force as well as the force applied by the hand of the user.

Referring to FIG. 5, it will be noted that a conventional wrecking bar 26 which forms a relatively small angle $\alpha$ within the range of 40°–45° does not normally provide the same mechanical advantage as the utility bar in the present invention. For the same length shank and given applied force $F_a$ in a smaller force $F_r$ will result at the tapered prying portion 28. The tapered portion 28, which serves as one arm of the fulcrum, is indicated to have a length of $d_1$. When the bar is gripped a distance $d_2$ as shown, it results in a useful force component normal to the shank equal to $F_a \sin \alpha$. For an angle of $\alpha$ of 45°, the applied force $F_a$ is reduced by approximately 30%. The useful component of the applied force, in this case, is that component which is normal to the shank.

Figure 6:
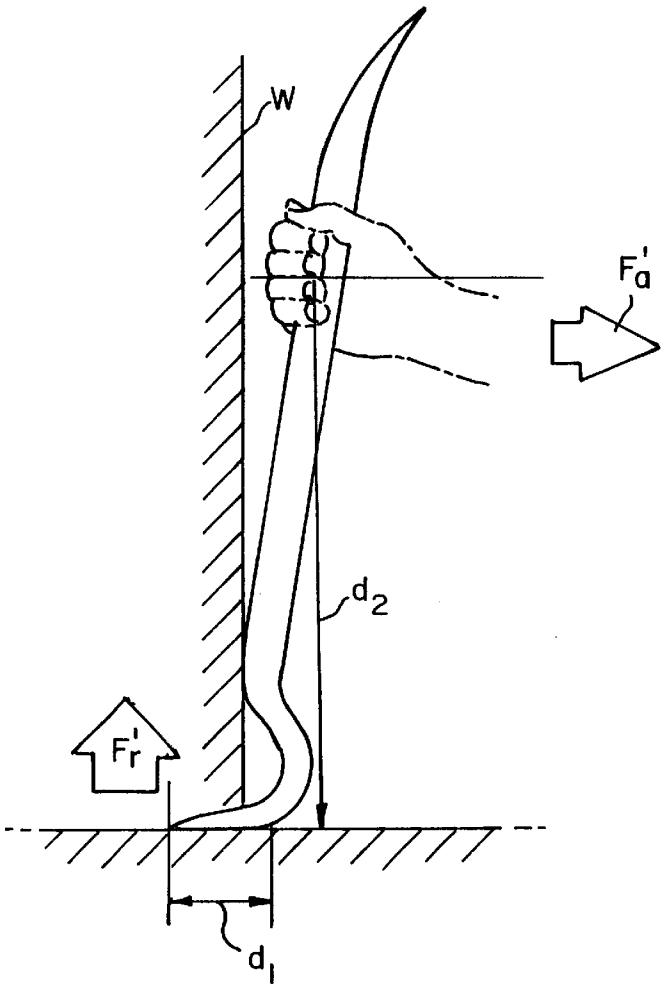
FIG. 6 is similar to FIG. 5, but illustrating the comparable forces in connection with the utility bar of the present invention.

In FIG. 6, it will noted that because the shank 11 is substantially normal to the direction of the applied force $F_a'$, the resulting force $F_r'$ is significantly greater, for the same length of shank. It has been noted, thus, that the leverage with the present invention is substantially increased over conventional wrecking bars. For example, for a 24 inch bar, a 52% increase has been observed, while in a 36 inch bar, an approximately 58% increase has been obtained. This means, of course, that such increased leverage can either reduce the required level of forces that need be applied by the user or significantly increase the forces that can be applied to move or pry an object with the same forces applied by the user.

Figure 7:
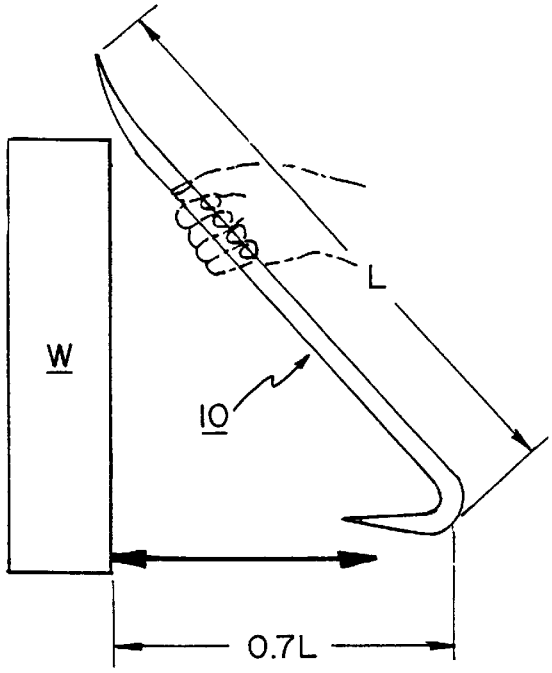
FIG. 7 PRIOR ART
FIG. 7 is similar to FIG. 6, but illustrating the inherent limitations in the use of a prior art wrecking bar when used proximate to an adjacent wall or vertical surface.
Figure 8:
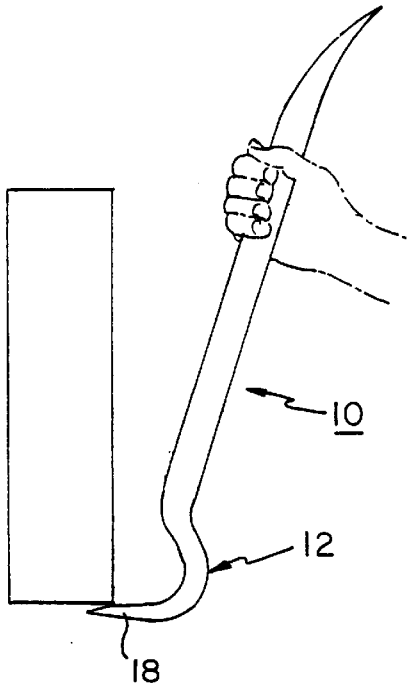
FIG. 8 is similar to FIG. 7, but illustrating how the utility bar of the present invention overcomes this disadvantage inherent in the use of the wrecking bar shown in FIG. 7.
Figure 9:
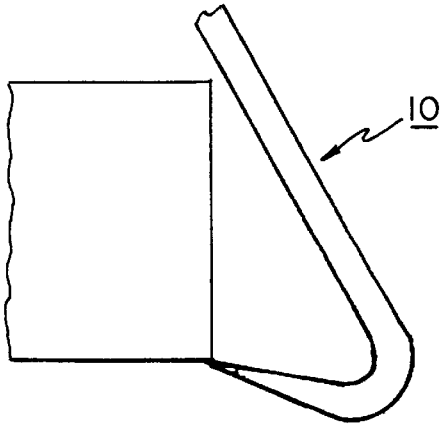
FIG. 9 PRIOR ART
FIG. 9 is a side elevational view of a conventional wrecking bar, illustrating the inherent limitation in the use of such bar in connection with the lifting or prying of a product which has a given height.
Figure 10:
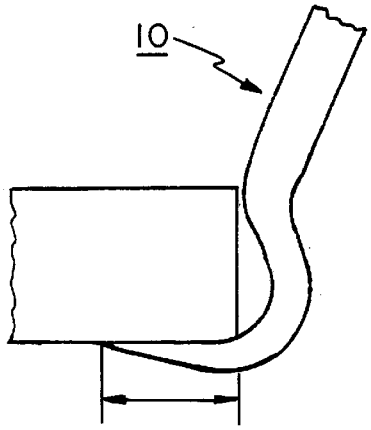
FIG. 10 is similar to FIG. 9, but illustrating the manner in which the improved utility bar of the present invention overcomes the disadvantage illustrated in FIG. 9.

In FIG. 7, the conventional prying bar of FIG. 5 is illustrated when an attempt is made to use such bar to pry an object in close proximity to a horizontal surface, such as a wall W. With a 45° angle $\alpha$, it will be clear that for a given length shank L, it is difficult to insert the tapered or beveled edge of the prying hook between surfaces which are closer than approximately 70% of the length of the bar to the wall. In FIG. 8, however, it will be noted that the improved utility bar of the present invention allows the tapered edge 18 of the prying hook 12 to be inserted below an object for substantially all distances of the shank to the horizontal wall or object. A similar difficulty is noted in FIG. 9, with the conventional wrecking bar, where, again, the very nature of the configuration of the prying bar prevents the tapered edge of the prying hook from being inserted below an object which has any significant height, since the upper portion of the object makes contact with the shank itself. In FIG. 10, it is clear that the present invention has no such limitation or restriction, and the tapered edge of the prying hook can penetrate below a surface a distance "D" with almost no interference whatsoever from the shank.

It will be clear that, by selecting the angle a to be within the range of 93°–110°, a user can get closer to walls, whereas this is not always possible with standard bars. Also, by providing an oblong or oval cross sectional dimension for the shank, as opposed to a sheet of flat metal or hex cross section shank, the user can apply significantly greater forces to the shank without incurring discomfort or pain, or possible injury. The additional rounded grip area provides greater comfort to the user and facilitates the use of the bar under most conditions. By providing increased prying footprints for both the prying hook and the prying chisel, substantially more support area is provided at both ends of the utility bar, approximately three times the support area for the prying hook and approximately two times the support area for the prying chisel end. Such increased support areas provide more control for the user and resist sinking of the fulcrum points at both ends into the surface against which pivoting takes place, and avoids possible deformation and damage to such surface. By selecting a core work length which is slightly greater and more easily accessible than prior bar constructions, a lower profile is obtained which fits further and more easily under the workpieces. In this connection, a claw tip width has also been increased as compared to conventional wrecking bars and, by making such claw tip width approximately 43 mm, approximately 12% greater width is provided for improved leverage. The same is true for the chisel tip width, which, at 35 mm, provides approximately 22% more width leverage.

It will be clear, from the foregoing, that the improved utility bar of the present invention overcomes the disadvantages of numerous prior known designs, and the resulting utility bar becomes so universal it can be used in most applications for which such tools are used, without the need to resort to a multiplicity of utility bar designs to achieve a large number of functions.

Although the present invention has been described in relation to particular embodiments thereof, many other variations, modifications and other uses will become apparent to those skilled in the art. It is the intention, therefore, that the present invention not be limited by the specific disclosure of the embodiments therein, but only by the scope of the appended claims.

What is claimed:

1. A prying bar comprising an elongate shank having a predetermined cross section and defining a longitudinal axis and having a prying hook at one end and a prying chisel at the other end, said prying hook having a tapered portion and a generally U-shaped portion integrally formed with said shank and said tapered portion generally defining a common plane, said tapered and U-shaped portions forming a prying footprint surface facing a direction away from said shank, said prying footprint surface having a minimum transverse dimension which is substantially greater than the minimum cross sectional dimension of said shank, and said predetermined cross section having a major axis generally parallel to said plane and a minor axis generally normal to said plane, whereby the strength of the prying bar in applying forces at said prying hook and said prying chisel can be maximized and the bending of said prying bar shank can be minimized while enhancing the comfort gripping said prying bar shank by a user.

2. A utility bar as defined in claim 1, wherein said shank has a generally oblong cross section.

3. A utility bar as defined in claim 2, wherein said cross section defines major and minor axes having relative dimensions approximately in the ratio of 2:1.

4. A utility bar as defined in claim 2, wherein said cross section has a major axis generally parallel to said tapered portion.

5. A prying bar comprising an elongate shank having a predetermined cross section and defining a longitudinal axis and having a prying hook at one end and a prying chisel at the other end, said prying hook having a tapered portion and together generally U-shaped portion integrally formed with said shank and said tapered portion generally defining a common plane, said tapered and U-shaped portions forming a prying footprint surface facing a direction away from said shank, said prying footprint surface forming the fulcrum point about which prying takes place, said tapered and U-shaped portions having a width dimension in a direction transverse to said plane greater than the corresponding dimension of said shank in said transverse direction, a transition in said dimensions taking place at a location generally where said shank is connected to said U-shaped portion.

6. A utility bar as defined in claim 5, wherein a minimum transverse direction of said prying hook footprint is equal to approximately twice the minimum cross sectional dimension of said shank.

7. A utility bar as defined in claim 5, wherein said longitudinal axis generally bisects said prying hook with said tapered portion being arranged on one side and said generally U-shaped portion being arranged on the other side of said longitudinal axis.

8. A utility bar as defined in claim 5, wherein said prying hook and said prying chisel have working lengths approximately equal to each other.

9. A utility bar as defined in claim 5, wherein said prying chisel defines a prying footprint during use having a minimum transverse dimension which is greater than the minimum cross sectional dimension of said shank.

10. A utility bar as defined in claim 5, wherein said tapered portion is provided with a beveled edge to facilitate penetration against a surface to be moved.

11. A utility bar as defined in claim 5, wherein said prying chisel is provided with a beveled edge at the free end thereof to facilitate penetration against a surface to be moved.

12. A utility bar as defined in claim 5, wherein said utility bar is made of steel.

13. A utility bar as defined in claim 12, wherein said steel is forged steel.

14. A utility bar as defined in claim 12, wherein said steel is heat treated.

15. A utility bar as defined in claim 5, wherein said tapered portion is provided with a generally V-shaped notch suitable for engaging a nail head.

16. A utility bar as defined in claim 5, wherein the dimensions of said prying hook and prying chisel along the direction of said longitudinal axis are approximately the same.

17. A utility bar as defined in claim 16, wherein the dimension of said prying hook is less than the dimension of said prying chisel along the direction of said longitudinal axis.

18. A utility bar as defined in claim 5, wherein a minimum transverse dimension of said prying chisel footprint is substantially greater than the minimum cross sectional dimension of said shank.

19. A prying bar comprising an elongate shank having a generally oblong cross section and defining a longitudinal axis and having a prying hook at one end and a prying chisel at the other end, said prying hook having a tapered portion and together generally U-shaped portion integrally formed with said shank and said tapered portion generally defining a common plane of symmetry extending through the centers of said shank, prying hook, prying chisel and U-shaped portion, said tapered and U-shaped portions forming a prying footprint surface facing a direction away from said shank, said prying footprint surface forming the fulcrum point about which prying takes place, said shank having a major axis within said common plane greater than a minor axis along a direction transverse to said common plane.

* * * * *

UNITED STATES PATENT AND TRADEMARK OFFICE

CERTIFICATE OF CORRECTION

PATENT NO. : 6,257,553 B1
DATED : July 10, 2001
INVENTOR(S) : Khachatoorian, Zareh It is certified that error appears in the above-identified patent and that said Letters Patent is hereby corrected as shown below:

Title page,
Item [63], please add,
-- [63] Related U.S. Application Data,
Continuation of Application No. 09/120,528, filed on July 22, 1998, Patent 5,957,429. --

Signed and Sealed this

First Day of July, 2003

JAMES E. ROGAN
*Director of the United States Patent and Trademark Office*